United States Patent [19]

Roberts

[11] Patent Number: 4,848,196

[45] Date of Patent: Jul. 18, 1989

[54] QUICK RELEASE AND AUTOMATIC POSITIVE LOCKING MECHANISM FOR SOCKET WRENCHES AND EXTENSION BARS FOR SOCKET WRENCHES

[76] Inventor: Peter M. Roberts, P.O. Box 15762, Red Bank, Tenn. 37415

[21] Appl. No.: 888,086

[22] Filed: Jul. 17, 1986

Related U.S. Application Data

[63] Continuation of Ser. No. 663,841, Oct. 23, 1984, abandoned, which is a continuation-in-part of Ser. No. 362,769, Mar. 29, 1982, abandoned.

[51] Int. Cl.[4] ..... B25G 3/02

[52] U.S. Cl. ..... 81/177.85; 403/379

[58] Field of Search ..... 81/60–63.2, 81/177.2, 177.85; 285/404, 305; 403/324, 327, 328, 378, 330, 379; 279/86, 93, 94

[56] References Cited

U.S. PATENT DOCUMENTS

| | | | |
|---|---|---|---|
| 1,569,117 | 11/1924 | Carpenter . | |
| 1,660,989 | 1/1927 | Carpenter . | |
| 1,775,402 | 9/1930 | Mandl | 81/177.2 X |
| 1,864,466 | 9/1930 | Peterson . | |
| 2,072,463 | 3/1937 | Mims . | |
| 2,108,866 | 2/1938 | Mandl . | |
| 2,290,215 | 11/1939 | Stenberg | 287/53 |
| 2,721,090 | 3/1952 | Kaman | 287/119 |
| 2,736,562 | 10/1953 | Blackburn | 279/76 |
| 3,011,794 | 12/1961 | Vaughn . | |
| 3,018,866 | 12/1961 | Vaughn | 81/177.85 X |
| 3,069,945 | 12/1962 | Shandel | 81/177.85 X |
| 3,094,344 | 6/1963 | Varga | 403/379 |
| 3,156,479 | 4/1963 | Drazick | 279/76 |
| 3,167,338 | 10/1963 | Troike | 287/119 |
| 3,208,318 | 9/1965 | Roberts . | |
| 3,515,399 | 6/1970 | Wordsworth . | |
| 3,613,221 | 10/1971 | Pronk | 403/379 X |
| 3,822,074 | 7/1974 | Welcker | 285/404 X |
| 3,890,051 | 6/1975 | Biek . | |
| 4,367,663 | 1/1983 | Merics . | |
| 4,399,722 | 8/1983 | Sardo, Jr. . | |
| 4,480,511 | 11/1984 | Nickipuck | 81/177 G |

FOREIGN PATENT DOCUMENTS

| | | | |
|---|---|---|---|
| 0066710 | 12/1982 | European Pat. Off. . | |
| 2121316 | 9/1972 | Fed. Rep. of Germany . | |
| 847209 | 6/1939 | France | 81/177.85 |

*Primary Examiner*—Debra Meislin

*Attorney, Agent, or Firm*—Willian Brinks Olds Hofer Gilson & Lione Ltd.

[57] ABSTRACT

A quick-release and positive locking mechanism adapted for use on tools for receiving removable sockets, and particularly adapted for use on extension bars of the type frequently employed with socket wrenches. One form of the mechanism comprises a drive stud having a diagonally disposed bore or opening extending therethrough and having a movable member mounted in said bore with its lower end adapted to extend beyond the contour of the bar and into a recess in the socket or like attachment to hold the same when in one position and to be withdrawn from said recess to release the socket or like attachment in another position and with its upper end extending beyond the contour of the drive stud above said socket or like attachment for access for manual movement. The angle of the bore or opening and the construction of the pin is such that force exerted to remove an attached socket or other attachment cannot generate a component of force on said movable member in the direction of its possible movement such as would cause an accidental or unintended release of said socket.

53 Claims, 5 Drawing Sheets

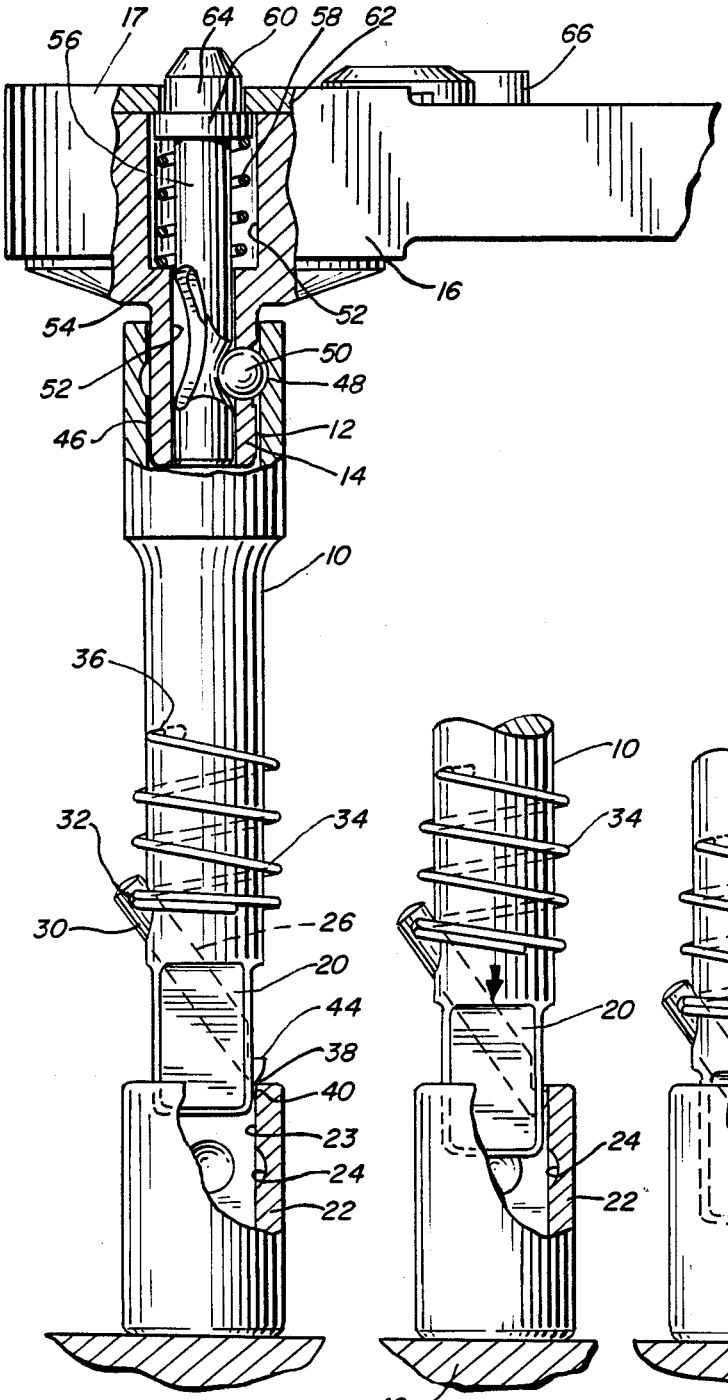
FIG. 1
FIG. 2
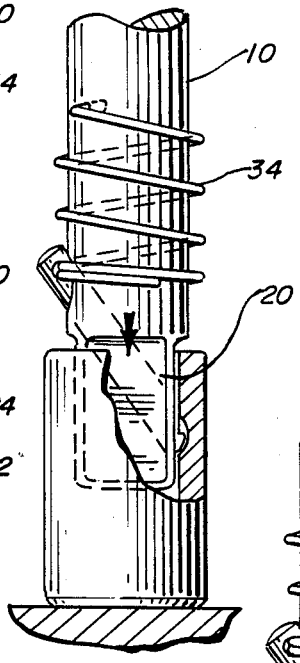
FIG. 3
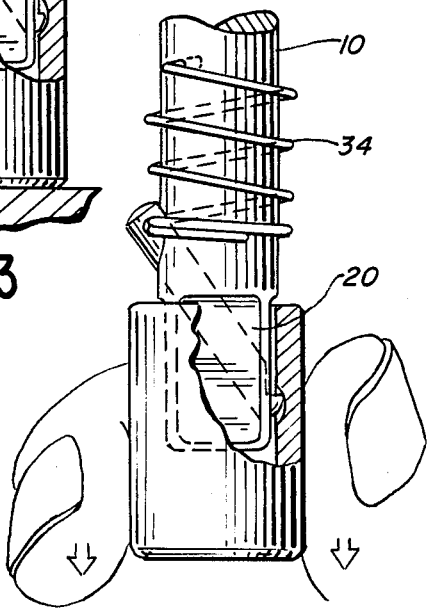
FIG. 4
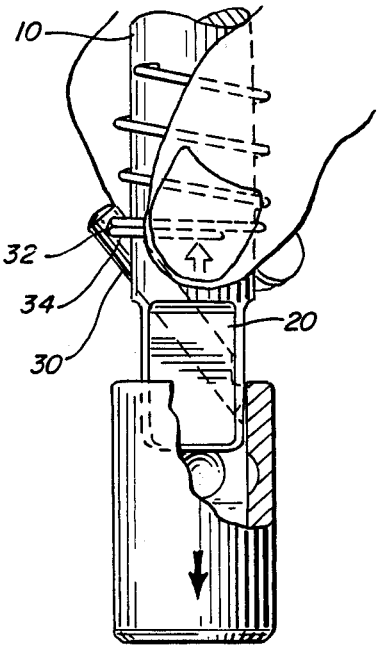
FIG. 5

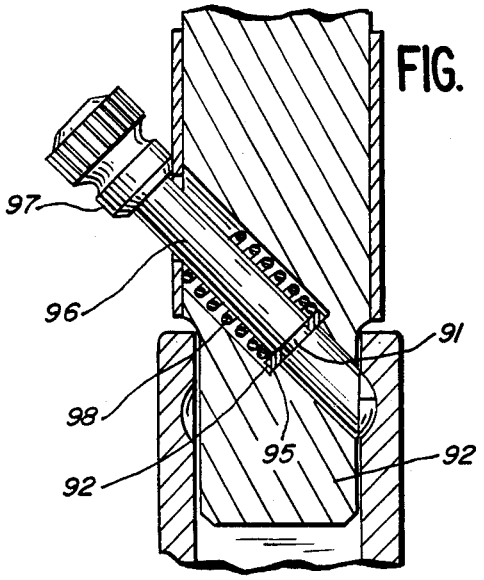
FIG. 8
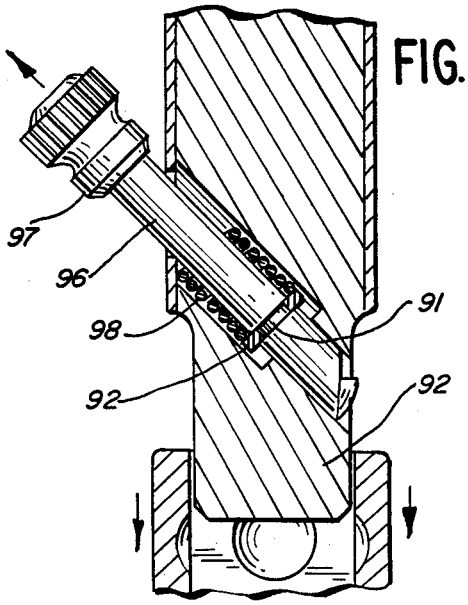
FIG. 9
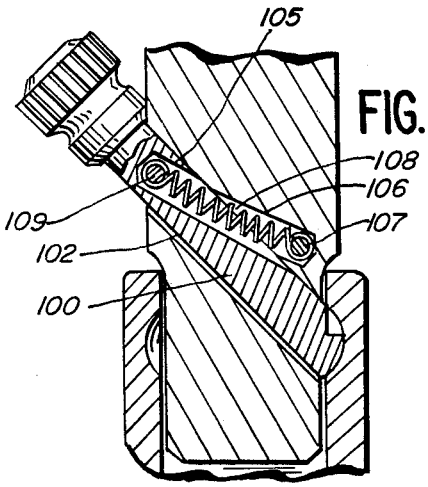
FIG. 10
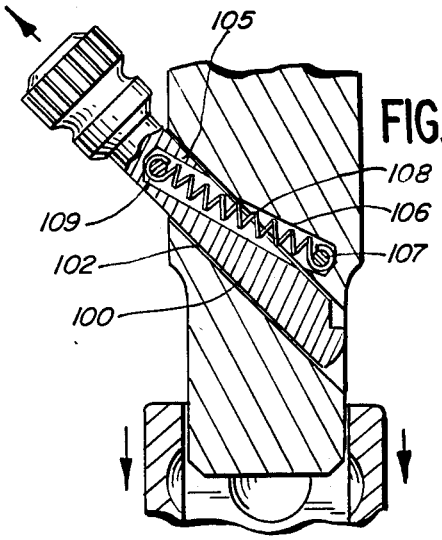
FIG. 11
FIG. 6
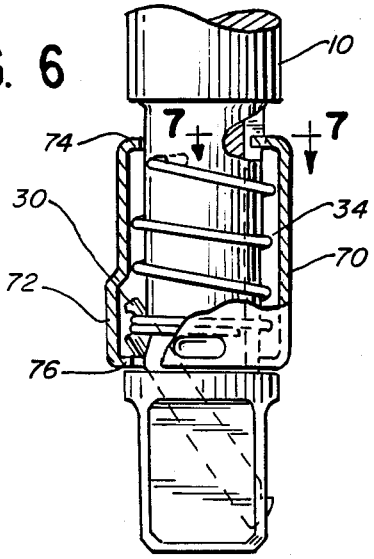
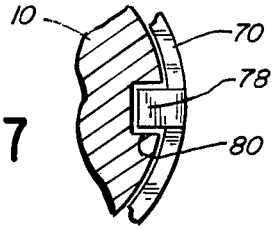
FIG. 7

FIG. 16
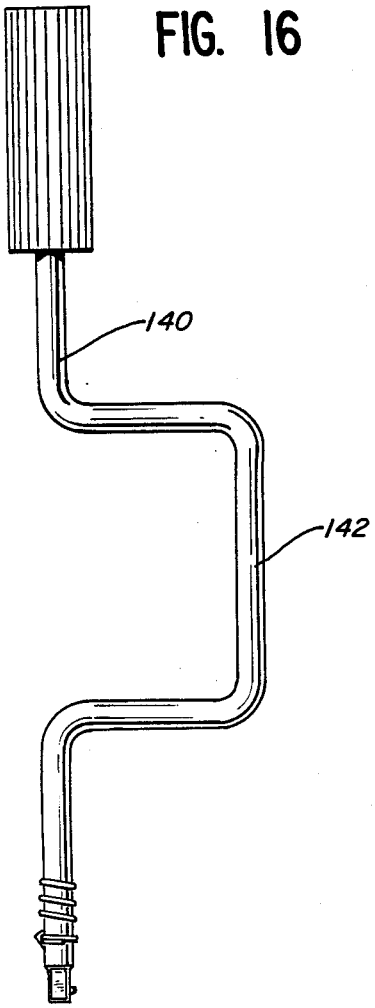
FIG. 17
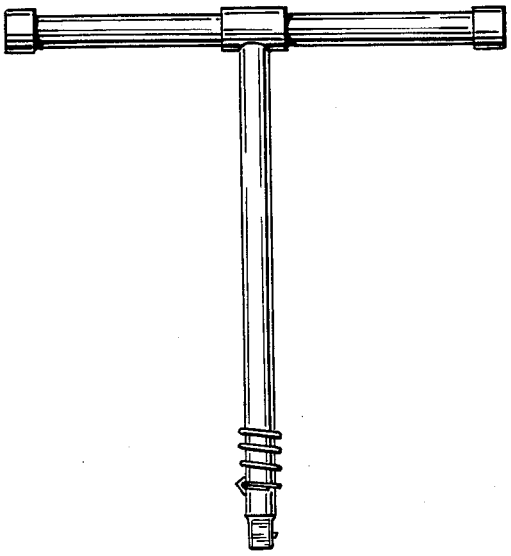
FIG. 18
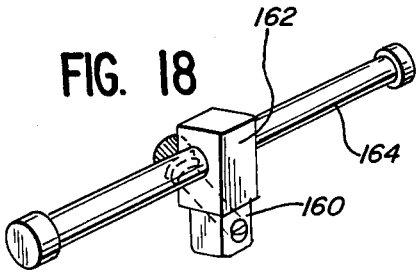
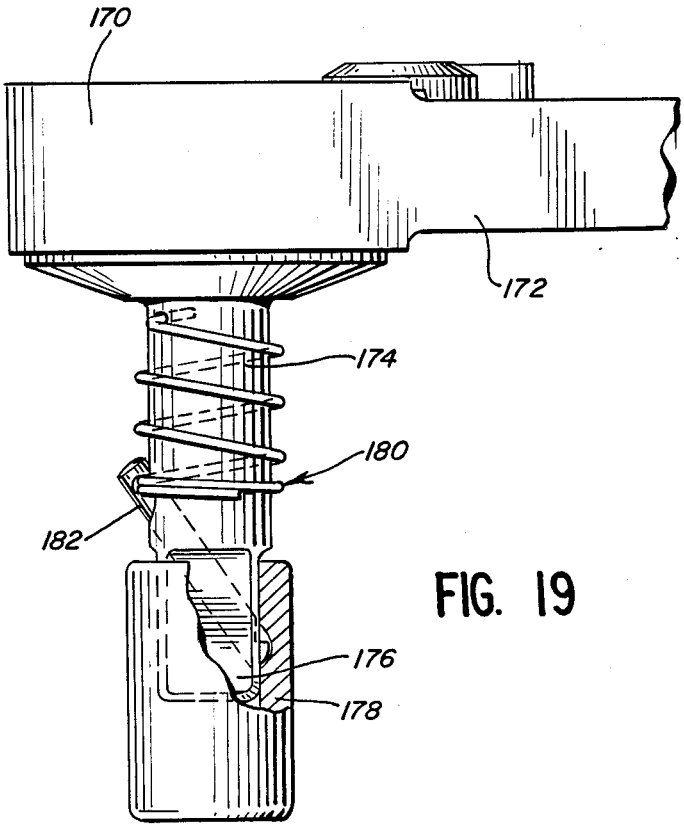
FIG. 19

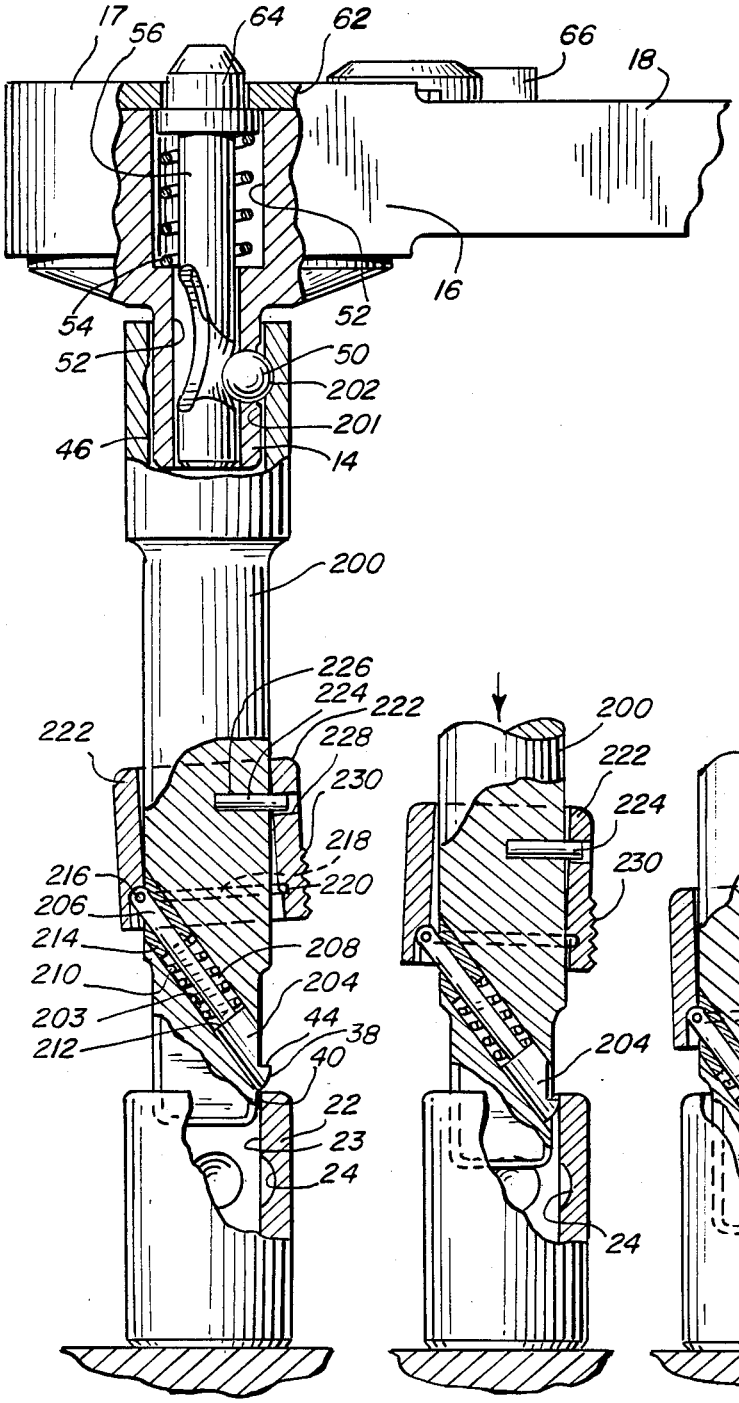
FIG. 20
FIG. 21
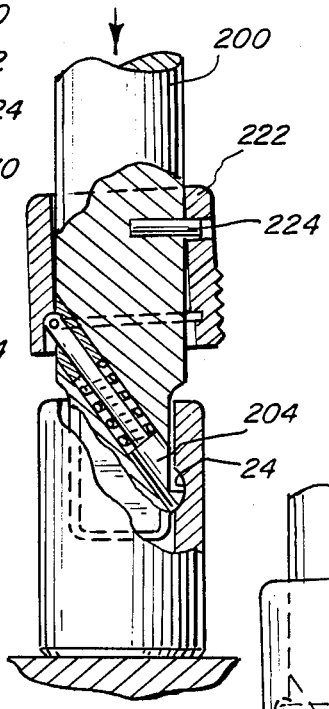
FIG. 22
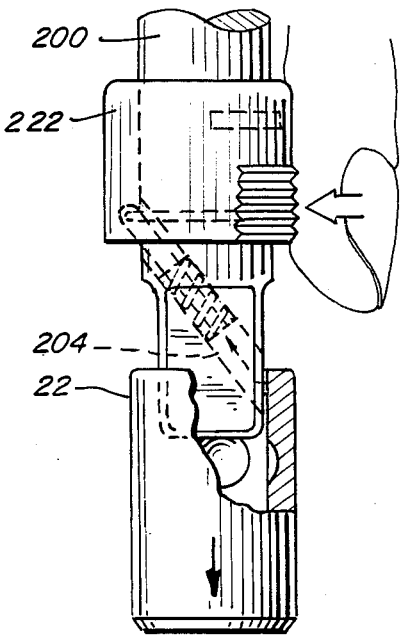
FIG. 24
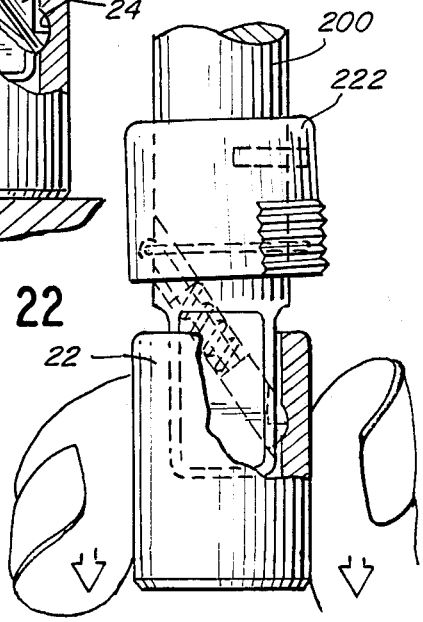
FIG. 23

QUICK RELEASE AND AUTOMATIC POSITIVE LOCKING MECHANISM FOR SOCKET WRENCHES AND EXTENSION BARS FOR SOCKET WRENCHES

This application is a continuation of application Ser. No. 663,841, filed Oct. 23, 1984, now abandoned, which is in turn a continuation-in-part of application Ser. No. 06/362,769, filed Mar. 29, 1982, now abandoned.

BACKGROUND OF THE INVENTION

This invention relates to mechanism for securely retaining sockets or other tool attachments on, and easily releasing them from, socket wrenches and other torque-transmitting tools, and is particularly adapted for use with extension bars of the type now commonly used with wrenches. The mechanism of this invention can generally be used on all hand-held tools, including power and impact tools having removable sockets or other tool attachments and in particular can be used with hand-held socket wrenches including ratchet wrenches.

This application is a continuation in part of applicant's co-pending application Ser. No. 06/362,769, filed Mar. 29, 1982 and entitled "Quick Release and Automatic Positive Locking Mechanism for Socket Wrenches and Extension Bars for Socket Wrenches."

Whereas this invention may be employed with various types of wrenches or other torque tools, in its application to wrenches it is especially adapted for use on wrenches and tools that have drive studs at least slightly longer than the drive studs conventionally employed on ratchet wrenches. This invention is also particularly well suited for use on extension bars of the type now frequently employed to transmit torque to attachments for socket wrenches for reaching work located in remote or otherwise inaccessible places, thus making the socket wrench a more versatile tool.

Socket wrenches of the type referred to herein have a handle, a head or other torque transmitting portion, and a square, hexagonal or like drive stud for receiving removable sockets or other tool attachments.

For many years prior to the invention of a quick-release mechanism for socket wrenches (first disclosed in U.S. Pat. No. 3,208,318, Roberts), removable sockets were usually secured to the wrench by a conventional ball detent device which in use necessitated that the sockets be manually pushed onto and pulled off of the drive stud of the wrench against the resistance of the ball detent.

In the conventional ball detent design, the ball detent is spring mounted in an aperture in the drive stud with the normal position of the ball detent being in an outward position, that is, with the ball projecting outward of the surface of the drive stud. When the socket is mounted on the drive stud, the spring loaded detent protrudes from the exterior surface of the drive stud to engage a recess in the socket and thereby hold the socket onto the drive stud. To remove the socket from this conventional ball detent design stud, the user normally grasps the socket with one hand and exerts a pulling force on it while firmly holding the wrench against said pulling force with his other hand, thereby forcing the spring loaded ball detent to recede into the aperture so that the socket can be pulled or pried off and thus released from the drive stud.

This conventional manner of securing and releasing sockets, however, resulted in a great many practical difficulties. One of these problems was that the removal of the socket required the use of both of the user's hands: one hand to hold the handle of the wrench and the other hand to pull the socket off the drive stud. Removal of the socket in this manner became a particularly time-consuming and labor wasting task, especially when the socket or the user's hands became greasy and it consequently became difficult for the user to grasp and hold the socket while pulling on it. This problem was exacerbated by the spring necessarily present in a new wrench which had to be quite stiff if the spring was constructed to exert a force sufficient to retain a socket or other attachment through the expected life of the wrench.

Moreover, removal of this socket proved difficult or impossible if the conventional ball detent spring mechanism jammed, as it sometimes did when it became contaminated with dirt or grease, both of which are, of course, ordinarily present in the working places of mechanics who frequently use such tools. The consequence of such contamination was that a great deal of force was ordinarily required to remove the socket.

As a makeshift remedy for these problems, users frequently removed the socket from the wrench by prying it off with a screwdriver or other levering device. Indeed, the problem became so acute that some manufacturers offered special tools to pry off sockets. This time-consuming procedure of removing sockets from wrenches became particularly troublesome for commercial mechanics, who frequently use such wrenches for many hours during the day and change sockets many times during that period.

As indicated above, the first and only fully effective solution to this problem was provided by the "quick-release" mechanism disclosed in the above-identified Roberts patent. As shown in that patent (FIGS. 1, 2, 3, 4), a longitudinal passage in the drive stud receives a slidable pin, one end extending through the top of the head of the wrench and terminating in a control knob and the other end substantially flush during normal operation with the bottom face of the drive stud. The drive stud has an aperture for receiving a ball detent, the edges of the aperture preventing the ball detent from passing outside the stud.

A coil spring mounted in a section of said longitudinal passage maintains the pin normally in a position to keep the ball detent in an outward position, the ball detent thereby normally engaging and securely holding the socket. The slidable elongate pin is provided with a recess, so that when the operating button is depressed, the pin moves longitudinally in the passage until the detent is received in the recess. At that point, the socket is no longer secured to the drive stud and can be permitted to drop off through the force of gravity.

The above-described invention proved to be a remarkable success that was quickly adopted in most conventional socket wrenches and virtually revolutionized the socket wrench field. It enabled for the first time users of socket wrenches to easily and swiftly remove sockets from socket wrenches and replace sockets on the drive stud with little effort, and while using only one hand. One-handed operations were a decided time and cost advantage when, for example, a mechanic needed one hand to change a socket while holding a part he was working on in place with the other hand. Today, a large percentage of all socket wrenches in use are provided with some mechanism to facilitate the release of sockets from wrenches.

Roberts' quick-release mechanism, however, did not provide for positive locking of the socket onto the drive stud to prevent accidental release of the socket. This added feature would be highly useful on many power and impact tools and also on socket wrenches when, for example, work is being done on bridges or high buildings or the like where the accidental loss of a socket by unintended release not only produces the serious problems of replacing the lost socket but also the likelihood of damage to valuable or delicate machinery or property below and even danger to life.

There are numerous other circumstances where a positive locking mechanism would be highly desirable. For example, in using socket wrenches in repetitive tasks requiring prolonged use of the same tool attachment, a positive locking mechanism is highly desirable. In another circumstance, it is sometimes necessary to employ what is referred to as an extension bar to facilitate the removal of bolts that would otherwise not be accessible to a mechanic. An extension bar is ordinarily secured to the drive stud of the wrench, as is any regular socket and at its other end it is provided with a similar drive stud for receiving a socket. Prior to the present invention the sockets were retained on and released from the extension bar drive stud by a conventional ball detent mechanism of the kind described above.

With such detent mechanism a user removed a socket from the extension bar, by simply pulling it off. But in doing so, it was imperative that he not also remove the extension bar from the wrench drive stud, (which would often happen with a conventionally designed ball detent mechanism) as to do so would be frustrating and time consuming, requiring a three-hand operation. The incorporation of a locking mechanism onto the socket wrench to securely lock the extension bar onto the drive stud alleviates this problem. Mechanism for accomplishing such locking of extension bars as well as sockets and other tool attachments is now the subject of this inventor's U.S. Pat. No. 4,420,995, issued Dec. 20, 1983.

Extension bars of the type here referred to are employed when it is necessary to project the socket into an inaccessible area but which can accommodate the extension bar and socket. Such situations are encountered frequently when working on various types of machines that have nuts, bolts or other work pieces closely surrounded by other machine parts or other objects which allow only limited working space such as will accommodate only an extension bar and socket. In such cases an extension bar of suitable length is required which has at its upper end a suitable recess adapted to be attached in driving relation to and be retained on the drive stud of a wrench and at its lower end a drive stud for receiving a socket or other tool attachment.

There is a need therefore, in the field of tools employing extension bars of the type here contemplated, to provide mechanism which is inexpensive, reliable and easily constructed by which sockets and other tool attachments may be easily applied to, firmly retained on and quickly released from the drive stud portion of the extension bars and by which the sockets and other tool attachments may be positively locked in operative association to effectively preclude the possibility of accidental release.

Whereas the invention here disclosed is of such construction that it is particularly well suited for use with extension bars, it is not to be so limited as the same construction can be used with the same functional advantages on wrenches of various sorts which employ sockets or other tool attachments, including for example ratchet wrenches, "speeder" wrenches, and "T-bar" wrenches (examples of which are disclosed herein) as well as other types of tools which are capable of embodying the structural features which characterize this invention.

OBJECTS AND SUMMARY OF THE INVENTION

It is an object of this invention to provide a mechanism for easily attaching sockets or other tool attachments to wrenches and for firmly retaining them in their atttached working relationship thereon against unwanted or accidental release therefrom while at the same time permitting a quick and easy release of such sockets and attachments at the will of the operator.

It is a further and particular object of this invention to provide a mechanism for the type above referred to which is so constructed and designed as to be readily applied to the drive stud portion of extension bars of the type frequently employed with such wrenches.

It is a further object of this invention to provide a mechanism for attaching sockets or tool attachments to wrenches or extension bars for wrenches by the simple operation of placing the drive stud portion thereof into the stud receiving opening in the socket or other attachment and moving the drive stud portion into final attaching position and which by such simple movement serves to lock the socket or other attachment in place and retain the same against removal by a pulling force such as would remove the same when held by the customary ball detent devices. In other words, an attaching mechanism which automatically achieves a positive locking of the socket or other attachment on the drive stud by the simple movement of attaching the two parts in the conventional manner.

These and other objects of the present invention will become apparent to one skilled in this art upon considering the following description when read in light of the accompanying drawings.

The present invention will be described as it is used on a usual hand-held ratchet socket wrench having a handle, a head, a usually square or hexagonal drive stud and an extension bar attached thereto which also has a drive stud portion at its lower end for receiving sockets or other tool attachments.

This invention in one of its forms is characterized as having a diagonally disposed bore or opening extending through the drive stud of the wrench or the extension bar, or other tool as the case may be, from one side to the opposite side and having a spring operated downwardly urged pin slidably mounted therein which is of sufficient length to simultaneously project beyond both sides of the drive stud, said bore and pin being so disposed angularly that when a socket or other attachment is in place on the drive stud the upper end of the pin projects outwardly beyond the outer surface of the drive stud at a point above the upper end of the socket or attachment and the lower end of the pin projects beyond the surface of the drive stud at a point within the drive stud receiving recess of the socket or attachment and in such position that it will extend into the conventional ball receiving recess now formed in properly manufactured sockets and attachments. Furthermore, the angle of the bore and pin is such that when the socket or attachment is pushed onto the drive stud of the wrench or extension bar and the upper edge of the socket or attachment exerts a camming force on the under surface of the end of the pin that force is sufficient to move the pin axially upwardly in the bore. Such movement permits the top of the socket or attachment to pass beyond the pin and permits the socket or attachment to enter into attaching relationship with the stud.

In addition the upper side of the inner end of the pin is so formed as to prevent any camming action betwen the inner surface of the socket and the pin such as could, in view of the selected angle of the bore and pin, generate an upward force in the direction of the pin axis such as would cause the pin to accidentally or unintentionally release the socket or attachment. Therefore, once in place the socket is firmly and positively locked on the stud until the operator deliberately moves the pin outwardly to release it. In fact any downward force on the socket causes the inner surface of the socket to press against the contacting portion of the pin which in turn pushes the pin more firmly into contact with the underlying surface of the bore, thereby more firmly locking the socket or attachment to the drive stud.

In the forms of this invention which employ a spring actuated pin, a suitable means is provided for preventing rotation of the pin in the bore in order that the location of the particular construction features above described for controlling the camming and locking actions is maintained.

In another form of the invention which employs the same diagonally disposed bore and pin construction functions without a spring and depends upon rotation of the pin to present two different sides of the pin's inner end, one of which allows the free movement of the socket on and off of the stud while the other locks the socket against release once placed on the stud. This form has additional means for locking the pin in either selected position.

Yet another form of this invention employs a lever pivoted in the diagonal opening in the drive stud of the wrench or extension bar which is spring pressed into a position presenting the inner end of the lever in locking engagement with the socket but which can be manually moved to permit a quick release of the socket.

DESCRIPTION OF THE DRAWINGS

FIG. 1 is a side elevational view partly in cross-section of a ratchet socket wrench, an extension bar, and a socket disposed for attachment to the lower end of the extension bar and showing this invention as applied to the lower end or drive stud portion of the extension bar. The quick release and positive locking mechanism shown in the wrench head and wrench drive stud are constructed in accordance with the invention described and claimed in applicant's U.S. Pat. No. 4,420,995, issued Dec. 20, 1983.

FIG. 2 is a fragmentary view of the extension bar and the associated socket disclosed in FIG. 1 but showing the drive stud of the extension bar partially moved downwardly into the socket and with the pin cammed upwardly to allow the further downward movement of the drive stud.

FIG. 3 is a view similar to FIG. 2 showing the drive stud of the extension bar moved downwardly into its final locking position in the socket with the pin restored to its maximum downward position with its lower end projecting into the recess provided in the inner surface of the socket.

FIG. 4 is a view similar to FIG. 3 showing the relationship of the parts when the socket is positively locked on the driving stud of the extension bar. FIG. 4 illustrates the fact that when one pulls downwardly on the socket while so locked, the pin firmly resists further downward movement and prevents removal of the socket.

FIG. 5 is a view similar to FIG. 3 but showing that the operator by manually lifting the lower loop of the spring and consequently the pin attached thereto effects a quick release of the socket allowing the socket to drop from the drive stud by gravity.

FIG. 6 is a view of the lower end of the extension bar like that shown in FIG. 1 but without the associated socket and showing a modified form of the invention in which a protecting sleeve is provided in surrounding relation to the spring which can impart upward movement to the spring and pin for effecting a quick release of an attached socket.

FIG. 7 is a fragmentary cross-sectional view of the mechanism shown in FIG. 6 and taken on the line 7—7 and looking in the direction of the arrows.

FIG. 8 is a fragmentary elevation view partially in cross-section of the lower end of an extension bar embodying a modified form of this invention showing a slidable pin in lower locking position with the socket attached.

FIG. 9 is a view of the mechanism shown in FIG. 8 with the pin in the position it would occupy when manually moved upwardly to release the socket.

FIG. 10 is a view similar to FIG. 8 of yet another form of the invention and showing the pin in socket locking position.

FIG. 11 is a view of the mechanism shown in FIG. 10 with the pin in release position.

FIG. 16 is an elevational view of a manually operated wrench of the so-called "speeder wrench" type which is here shown as being provided with a drive stud portion constructed in accordance with this invention.

FIG. 17 is an elevational view of another manually operated wrench sometimes referred to as a "T-bar" type of wrench and here shown as provided with a drive stud constructed in accordance with this invention.

FIG. 18 is a view similar to FIG. 17 showing another form of "T-bar" wrench having a much shorter drive stud portion and also having its drive stud constructed in accordance with this invention.

FIG. 19 is an elevational fragmentary view partly in cross-section showing the type of socket attaching and releasing mechanism illustrated in FIGS. 1 to 5 inclusive, applied to a ratchet type of socket wrench instead of to extension bars for such wrenches.

FIGS. 20, 21, 22, 23 and 24 are views corresponding respectively to the views shown in FIGS. 1, 2, 3, 4 and 5 but showing still another modified form of this invention.

DESCRIPTION OF EMBODIMENTS OF THE INVENTION

Figure 12:
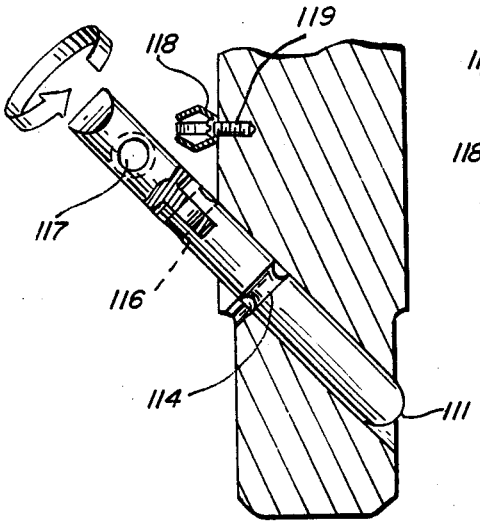
FIG. 12 is a fragmentary view partly in cross-section of a further modification of this invention shown as applied to the drive stud portion of an extension bar with the socket omitted and illustrating a rotary type of pin.

One preferred form of this invention is illustrated in FIGS. 1 to 5 inclusive of the accompanying drawings, and as there shown is embodied in an extension bar 10 having at its upper end a square opening 12 adapted to receive a drive stud 14 of a wrench designated generally as 16 and having a head 17 and a manually operable handle 18. The extension bar can be of any desired length and in practice it is contemplated that a plurality of different length bars will be available to a user of the wrench in order that a bar of the desired length may be selected for use at any particular time, and also in order that a short extension bar may be kept on a conventional or locking wrench at all times, for convenience, versatility and ease of operation except when a low profile tool is required for the job. The extension bar 10 comprises a drive stud upper portion and a drive stud lower portion 20 which in this instance is square but which may be of any other desired non-round shape and is adapted to fit into and have driving relation with a socket 22 or other similar attachment.

The socket 22 is conventional in its construction and is provided with a drive stud receiving central opening 23 having on its inside surfaces recesses 24 preferably one on each inner face of the square or other non-round opening in the socket each of which serves in use with conventional tools, to accommodate a ball of a spring pressed ball detent but which here serves to accommodate the holding and locking means of this invention.

As shown in the drawings the lower portion of the extension bar is provided with a diagonally disposed bore or opening 26 which is of a size to slidably receive a pin 30 therein. The pin 30 is of sufficient length to extend beyond the surface of the extension bar at its upper end when its lower end is extended into the recess 24 of the socket as shown in FIGS. 3 and 4.

At its upper end the pin 30 has a transverse hole 32 extending therethrough which receives the lower end of a coiled spring 34 which spirals around the above adjacent portion of the extension bar for a plurality of turns and is anchored at its upper end in an opening 36 in the extension bar. It is preferred to have the lower two coils of the spring 34 pass through the hole 32 in the pin 30. The coiled spring 34 is an expansion spring, that is to say, it is biased to exert a downward pressure on the upper end of the pin 30.

The spring in this embodiment serves an array of functions, including providing an axial stop for the pin, a rotational stop for the pin, a handle for releasing sockets by withdrawing the pin from the socket, a source of force for initially locking and retaining the socket on the tool and a means for automatically adjusting for wear on the pin. In addition, the use of the spring in this embodiment insures the lowest overall circumferential and rotational profile for the extension bar or other tool on which this invention is employed.

The lower end of the pin is provided on its under side with a rounded cam surface 38 which is adapted to contact the upper edge 40 of the socket opening 23 when the extension bar is moved downwardly into the opening 23 as shown in FIG. 1, and to serve to force the pin 30 upwardly and inwardly upon further continued movement of the extension bar 10 into the position represented by the illustration in FIG. 2. Thus when the desired socket is supported on a surface such as 42 as shown in FIGS. 1, 2 and 3 with its drive stud receiving opening 23 facing upwardly, the operator may introduce the lower end of the extension bar (which may or may not be attached in driving relation to a wrench) into the upper end of opening 23 of the socket and by the simple maneuver of moving it downwardly the pin is caused to move upwardly by the camming engagement between its lower end surface 38 and the upper edge of the socket 40, whereby the extension bar is free to continue its downward movement until it has reached its final position as illustrated in FIG. 3.

In this final position the socket is positively locked on the drive stud of the extension bar and it cannot be accidentally released nor can it be removed by being grasped and pulled from the end of the extension bar in the manner being attempted in FIG. 4. Rather a release can be effected only by the operator gripping the lower loop of the spring wire coil in the manner illustrated in FIG. 5 and lifting the spring 34 and the pin 30 as indicated by an arrow.

The locking action results from the fact that the angle of the diagonal bore 26 is such that the effort exerted on the end of the pin 30 by the inside surface of the recess 24 in the socket 22 cannot generate a component of force in the direction of the axis of the pin 30 such as would cause the pin to move upwardly axially. Rather the force so exerted tends to move the end of the pin 30 downwardly into tighter frictional engagement with the under side of the bore 26. To effect the locking above described the upper surface of the end of the pin 30 may be shaped to form a step 44 but such step is not essential, as a conventional rounded tip on the pin may be successfully employed in most circumstances.

In the construction shown, the pin 30 is round in cross-section as is the bore 26 which receives it, and in this case the rotation of the pin 30 in the bore 26 is prevented by the attachment of the pin 30 to the end of the spring 34. It will be understood, however, that the pin could be square or other non-round shape and in this manner be held against rotation. Avoiding rotation of the pin 30 in the form illustrated is useful in order to maintain the positions of the upper and lower sides of the end of the pin 30 so as to assure the intended camming action when affixing a socket on the drive stud of the extension bar and the locked status of the socket when once so affixed.

When this invention is applied to extension bars the upper end of such bars 12 are constructed with a central opening 46 which may be square as shown or of other non-round shape and are adapted to fit in and be driven by the drive stud 14 of a wrench indicated generally at 16. In addition, the inside flat surfaces of the opening 46 preferably are each provided with a recess 48 which, when used with conventional wrenches, are adapted to receive a ball of a spring pressed ball detent now commonly used for attaching drive studs of wrenches to sockets.

Inasmuch as the extension bar of this invention is intended to be interchangeable with such sockets, when used with such wrenches, the upper end of the extension bar of this invention, which attaches to the drive stud of a wrench, is in all respects similar to the corresponding parts of conventional sockets.

It is to be noted that the wrench here illustrated in FIG. 1 for use with the described extension bar is not of conventional construction but rather is constructed in accordance with applicant's invention described and claimed in U.S. Pat. No. 4,420,995, issued Dec. 20, 1983.

As there set forth the wrench quickly releases sockets in the manner disclosed in applicant's U.S. Pat. No. 3,208,318, issued on Sept. 28, 1965, and in addition provides a positive locking capability which eliminates all accidental or unintended release of sockets, extension bars or other attachments from the drive studs of wrenches.

As shown in FIG. 1 the drive stud 14 of the wrench has an axial opening 52 extending therethrough which is of larger diameter at its top portion to provide a step 54 therein. Located in the opening 52 is a slidable and rotatable pin 56 having recessed portions in its lower cylindrical surface which result in the particular contour represented in the drawing and fully illustrated and described in applicant's U.S. Pat. No. 4,420,995, referred to above. In said patent it is made clear that one recessed portion serves to hold the ball 50 in socket attaching engagement when the pin is in upper spring pressed position and to release the ball when the pin is manually pressed downwardly, and that another recessed portion also cooperates with ball 50 when the pin is rotated through a predetermined angle and thus serves to hold the ball in locking contact with the socket. When the pin so locks the ball, the pin is in turn locked against downward movement by the ball.

The upper portion of the pin 56 is surrounded by a coil spring 58 which has its lower end seated on the step 54 and its upper end pressing against the under surface of collar 60 preferably formed as a part of the pin 56. The spring 58 is an expansion spring and presses the collar 60 upwardly to normally maintain the pin in raised position with the collar 60 pressing against retaining plate 62 which maintains the parts in assembled relation. The pin 56 further has a control knob 64 extending upwardly through the plate 62 in position to be manually depressed (when the pin is in one rotary position) and which can be readily rotated a predetermined amount to effect a locking and unlocking of the quick release mechanism.

The wrench illustrated is a ratchet type wrench having a conventional control lever 66 as shown, but could be of any other type of wrench. However when the wrench and extension bar shown in FIG. 1 are employed together it will be noted that both the extension bar and the socket are attached to their associated driving stud parts by mechanisms which can be locked against accidental or unintended socket release and also can be readily unlocked and easily operated for quick release by the simple one-handed maneuver. Also the combination allows either attached part to be released and not the other, that is to say the socket may be released from the extension bar without releasing the extension bar from the driving stud of the wrench and vice versa.

It should further be noted that the locking and unlocking of the wrench release mechanism effected by rotating the control knob 64 as well as depressing the same can both be readily accomplished by one-hand maneuvers. Furthermore whether the invention here claimed is applied to the drive stud of a wrench or to the drive stud portion of an extension bar the unlocking and releasing can be effected by a simple one-handed maneuver which requires only that two fingers be extended downwardly on opposition sides of the spring 34 and the spring 34 and pin 30 lifted while holding the wrench, with or without an extension bar, in the palm of the same hand.

A somewhat modified form of the invention is illustrated in FIGS. 6 and 7. Here the diagonally disposed and slidably mounted pin with its associated coil spring are the same as those above described, but in addition a protective sleeve 70 is provided to cover the spring 34 and the upper end of the pin 30. The sleeve 70 is formed with an indented portion 71 to provide an inwardly projecting shoulder for engaging the lower loop of the spring 34, whereby the spring is lifted when the sleeve is lifted. Preferably the protective sleeve is provided with an outwardly extended portion 72 to create space inside the sleeve to accommodate the upward and outward movement of the end of the pin. Also the upper and lower ends of the sleeve are preferably extended inwardly to form flanges, as shown, at 74 and 76 respectively to better enclose the space and guide the movement of the sleeve. When the sleeve 70 is employed the bottom flange 76 constitutes a form of collar which provides a more positive means to be engaged for upward movement by the fingers of the operator. In order to prevent the sleeve from rotating and to better guide it in an axial path a tongue 78 may be provided for movement in a groove 80 formed in the extension bar 10.

Another modified form of this invention is illustrated in FIGS. 8 and 9 of the drawings. Like the first described form this form is shown as applied to an extension bar for a wrench.

As here shown the extension bar 90 has a drive stud portion 92 at its lower end which may be square or other non-round shape for driving attachment to a socket or other tool and also has a bore 94 extending diagonally therethrough from a position above the socket engaging area to a location within the socket engaging area of the extension bar. The bore is preferably enlarged at its upper portion to provide a step 95 therein. Within the bore a pin 96 is slidably mounted. The pin has a circumferential groove 91 formed intermediate its length which accommodates a ring 93 which serves as a seat for the lower end of a coil expansion spring 98. The coil expansion spring is biased to urge the pin in a downward direction. The upper end of the spring is retained in the upper portion of the bore 94 by a sleeve 99 which in this case surrounds a portion of the extension bar and encloses the space which accommodates the pin 96. The spring 98 is retained therein in compressed condition. The pin slidably projects therebeyond by extending through opening 93 provided in the sleeve 99 at the location of the bore axis.

The pin 96 has on its outer end a control knob 97 which enables it to be grasped by the operator and pulled outwardly and upwardly against the action of the spring 98 a distance sufficient to bring the lower end of the pin inside the contour of the drive stud portion of the extension bar. The lower end of pin 96 is formed the same as that of the pin 30 disclosed in FIG. 1 and its locking and releasing action is in all respects the same as previously described.

In FIG. 9 the device of FIG. 8 is shown with the pin in lifted position so that its lower end is in position to release a socket. It is to be understood that a socket may be attached by lifting the pin as illustrated in FIG. 9 and then inserting the drive stud portion of the extension bar into the socket and then permitting the spring 98 to return the pin to its lowermost position to thereby attach and lock the socket. On the other hand the drive stud portion may be inserted into the socket without lifting the pin, in which case, when the under cam surface of the pin engages the upper edge of the socket opening, in the manner shown in FIG. 1 an upward movement of the pin is effected without manually lifting the same.

Referring now to FIGS. 10 and 11 a still further modification of this invention is shown. Here the construction is in most respects like that shown in FIGS. 8 and 9, however a different type of spring is employed. The pin 100 is slidably mounted in a bore 102 of uniform diameter throughout its length, and the pin has a spring receiving opening 105 provided therein. In addition a complementary spring receiving opening 106 is provided in the extension bar disposed in the manner illustrated. These openings together provide a chamber for housing a contracting spring 108 which is attached at one end to the extension bar by holding means 107 and at its other end to the pin 100 by holding means 109. This form of the invention functions in all respects like that of the form of FIGS. 8 and 9 except that a contracting spring instead of an extension spring is employed.

Figure 13:
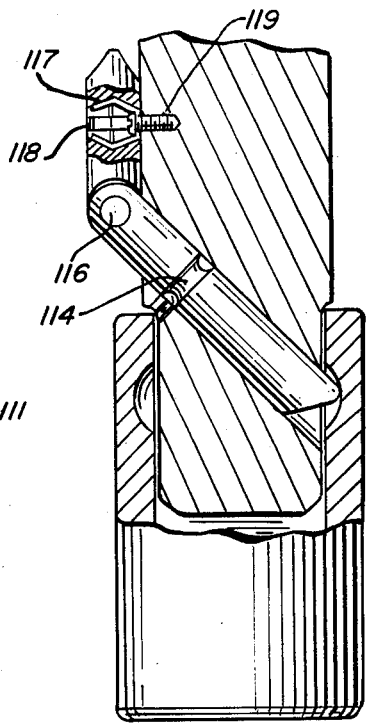
FIG. 13 is a view similar to FIG. 12 showing the same mechanism with the pin locked in socket holding position.
Figure 14:
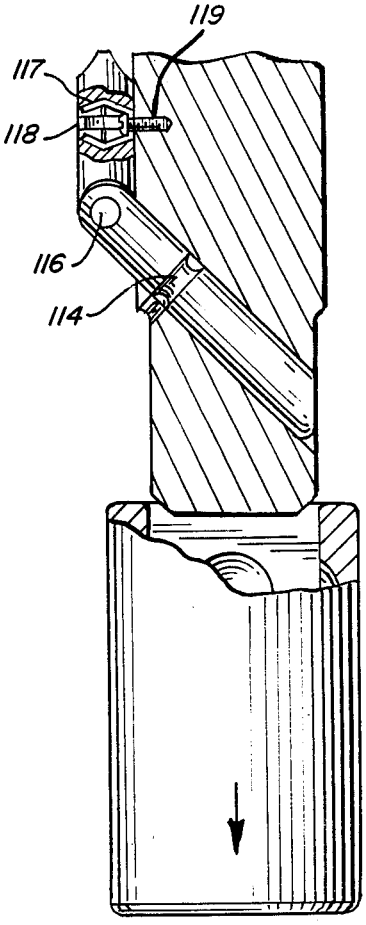
FIG. 14 is a view similar to FIGS. 12 and 13 showing the pin in position to permit quick release of the socket.

In the form of this invention illustrated in FIGS. 12, 13 and 14 a rotary pin is employed. In this form no spring is required. By referring to the drawings it will be noted that a diagonally disposed bore 110 is provided in the drive stud to accommodate a rotatable pin 112. All axial movement of the pin is prevented by a screw or like means 113 extending through the drive stud and fitting tangentially in the peripheral groove 114 with clearance sufficient to permit the pin to freely rotate.

The lower end of the pin 112 is formed with a diagonally disposed surface 111 which provides in one position of the pin 112 a portion of the tip of the pin which projects beyond the contour of the drive stud and cooperates with the adjacent recess in the associated socket and thus serves to affix the socket on the end of the extension bar. See for instance FIG. 13.

However in the position of the pin resulting from a 180° rotation thereof the projection referred to is moved into the confines of the contour of the drive stud whereby an attached socket or other tool is at once free to fall by gravity from the drive stud. See for instance FIG. 14.

In addition the outer end of the pin 112 is provided with a handle 115 which is pivotally attached as by means of a hinge 116 clearly shown in the drawings. The handle preferably has a locking means which here comprises a hole 117 formed through the handle and a latching device of the type illustrated consisting of spring fingers 118 or similar clip and a holding bolt 119 therefor mounted in the side of the extension bar in position to be received in the hole 117.

By comparing the showings in FIGS. 13 and 14 it will be seen that the pin 112 can be locked in either position, that is in socket holding position or in socket releasing position merely by freeing the handle as shown in FIG. 12 and rotating the pin 112 as represented by the arrow. When in the desired position the handle may be moved on its hinge 116 to cause the hole 117 to overlie the latching springs 118 and thereafter locking engagement therebetween can be effected.

Figure 15:
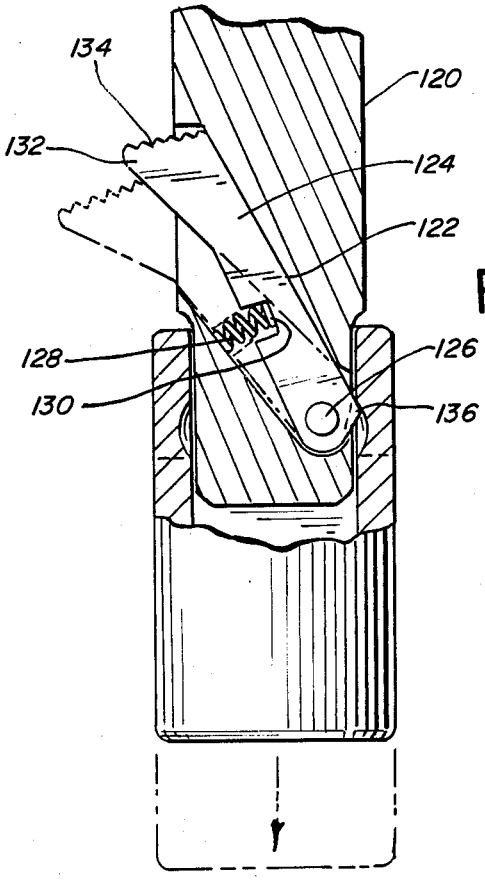
FIG. 15 is a fragmentary view partly in cross-section showing yet another form of this invention and one which employs a spring pressed pivoted lever in a diagonal opening in the drive stud which is capable of locking the socket onto the drive stud in one position and of allowing the quick release of the socket in another position.

In the form of the invention illustrated in FIG. 15 the extension bar 120 having a driving stud at its lower end is provided with a diagonally disposed slot 122 in which is mounted a lever 124 pivoted at 126 as shown. The lever 124 is urged by a compression spring 128 to normally occupy the position shown in full lines in FIG. 15. The spring 128 is seated at one end in the opening 130 in the lever and at its other end on the opposed surface of the slot 122. The upper end of the lever extends beyond the side surface of the extension bar as at 132 and may have serations 134 on its upper edge so as to be readily engaged by the thumb or finger of the operator for downward unlatching movement against the resistance of the spring. When in socket attaching position, that is, in the position illustrated in full lines in FIG. 15, the lever has a portion 136 which extends beyond the surface of the drive stud into locking engagement with the recess normally found in sockets or like attachments.

The lever effectively locks the socket in place on the extension bar because a downward force exerted on the socket will only serve to urge the lever in a clockwise direction as shown in FIG. 15, and thus against the upper surface of the slot. Accordingly to release the socket a positive and intended movement of the upper end of the lever must be made as a deliberate act by the operator.

It is to be understood that in addition to its application to socket wrenches as shown in FIG. 1 this invention may be applied to other forms of wrenches such, for instance, as those illustrated in FIGS. 16, 17 and 18, respectively. In FIG. 16 there is illustrated a so-called "speeder wrench" 140 which has a crank portion 142 for convenient manual operation and at its lower end a quick release socket attaching mechanism 144 like that illustrated in FIG. 1.

The same type of socket attaching mechanism is illustrated in FIG. 17 except that in this case the mechanism of this invention is shown as applied to the lower end of a so-called "T-bar" wrench having an operating shaft 150 and a handle 152.

In FIG. 18 there is shown another form of "T-bar" wrench comprising essentially a driving stud 160, a head 162 and a handle 164 along which the head may slide. In this form the socket attaching mechanism is that shown in either FIGS. 8 and 9 or in FIGS. 10 and 11.

FIG. 19 shows this invention applied to a ratchet type socket wrench instead of to an extension bar. In this form the head 170 and handle 172 therefor may be of any conventional construction but the drive portion 174 thereof may be slightly longer than customary. At its lower end a drive stud 176 for receiving a socket or similar attachment 178 is provided. This form of the invention permits the sockets to be picked up and retained on the drive stud by a positive locking action and to be quickly released by lifting the lower turn of the spring 180 and pin 182 as previously described with respect to the device of FIG. 1. It is also important that this operation can be carried out while holding the wrench in one hand.

It will be apparent that the socket attaching mechanism illustrated in FIGS. 8 through 15 inclusive can also be applied to a socket wrench head and handle of the type illustrated in FIG. 19.

Another form of this invention is illustrated in FIGS. 20 to 24 inclusive which, as will be noted, disclose a diagonally disposed bore extending through an extension bar, a spring pressed pin mounted in said bore and an associated sleeve movably mounted in surrounding relationship on the extension bar and operably engaging the upper extended end of the pin for manually moving the pin into releasing position and for allowing the pin to return to tool attaching position.

By referring to FIG. 20 it will be noted that in addition to the novel extension bar construction there is disclosed a wrench which in all respects is like the wrench shown in FIG. 1 and therefore requires no further description. In FIG. 20 the wrench parts illustrated which correspond to the wrench parts shown in FIG. 1 are identified by the same reference numerals employed in FIG. 1, wherefore its construction and operation will be understood to be the same as that previously described in connection with the showing in FIG. 1.

In addition FIG. 20 shows an extension bar 200 having at its upper end a square opening 201 adapted to receive the drive stud 14 of the wrench 16. The square opening preferably has depressions 202 formed in its side walls to receive the ball detent 50 in the manner shown. The lower end of the extension bar 200 is shaped to provide a drive stud adapted to fit into and drive a socket 22 or other tool attachment. The extension bar is also provided with a diagonally disposed bore 203 extending entirely through the extension bar which accommodates a pin 204 of such length that its upper end extends outwardly beyond the surface of the extension bar and its lower end, when in tool attaching position, extends beyond the surface of the extension bar in the manner illustrated in FIG. 22.

The pin 204 preferably has its upper portion 206 of reduced diameter to provide a space 208 which accommodates a spring 210 surrounding the reduced portion 206. It should be understood however that instead of reducing the size of the upper portion of the pin the bore could be enlarged to accommodate a spring the lower end of which could bear upon a flange or other means carried by the pin. The spring is designed to urge the pin 204 downwardly or into tool attaching position. The spring 210 is held between the shoulder 212 formed by the reduced portion 206 of the pin 204 and the bearing member 214 which closes the upper end of the space 208 and provides a bearing for the reduced portion 206 of the pin 204. The pin 204 is thus free to move axially to a limited extent in the bore and assume both release and tool attaching positions. Instead of providing a separate bearing member 214 the bore could have a smaller diameter at its upper end to provide the equivalent structure. The lower end of the pin 204 is constructed like the lower end of the pin 30 shown in FIG. 1 and it functions in cooperation with a socket or other tool attachment in the same manner.

The upper end of the pin 204 is preferably provided with an opening 216 or other means for connecting the pin 204 to an expanding locking ring 218 or the like. Ring 218 is adapted to fit into an annular groove 220 on the inside surface of an actuating sleeve 222 which surrounds the extension bar 200 in the manner shown. The sleeve 222 has an inside diameter somewhat larger than that of the adjacent portion of the extension bar. The sleeve 222 is held in operative position by a pin 224 which in turn is anchored in the extension bar as at 226 and projects into the slightly oversized opening 228 formed in the sleeve 222. This construction permits the sleeve to tip or cant under manual control in such a manner as to move the pin 204 upwardly, against the force of the spring 210, to release position or to move the pin 204 downwardly in response to the force of the spring 210 to tool attaching position. The sleeve 222 may be provided with a series of nonslip ridges 230 or other similar area to provide a thumb or finger engaging surface on the sleeve for convenient and easy manipulation of the sleeve and the tool releasing and attaching mechanisms.

FIG. 20 shows the extension bar starting to enter the receiving opening in a socket 22 with the lower end of the pin 204 in contact with the upper corner 40 of the socket.

FIG. 21 shows the extension bar moved into the socket opening after the pin 204 has been cammed inwardly and upwardly.

FIG. 22 shows the extension bar in full tool attaching position in the same manner as shown in FIG. 3.

FIG. 23 shows the parts of the device in the same relationship as shown in FIG. 22 but also illustrating the positive locking action and the socket being held against the downward pull on the socket by the operator.

FIG. 24 illustrates the action effecting the quick release of the socket by a simple inward movement of the operator's thumb or finger when in contact with the nonslip surface 230 of the sleeve 222.

Whereas this invention is applicable for use with wrenches as well as extension bars, the term "drive stud" is intended to refer not only to the square or non-round end of the drive member but also to that portion of the drive member above the square or non-round end, and accordingly the term "drive stud" is to be given this broader meaning in the appended claims except where more limited meaning is clearly indicated from the text as a whole.

It is apparent that any of the types of wrenches illustrated may be employed with any of the illustrated forms of socket latching mechanisms and that the extension bar constructions shown and described could each be used on wrenches constructed like that disclosed in FIG. 19. Further it should be understood that the invention is not to be limited to the illustrated forms but shall include all other forms that fairly fall within the scope of the appended claims.

It will be further apparent that all forms of this invention provide attaching and releasing means which are fully operable with one hand, and all forms that are spring loaded are selectively aligning with recesses of different depths in the sockets or other tools, and provide automatic and positive locking of the sockets or other tools on the drive stud.

I claim:

1. A tool comprising means for receiving and releasing a tool attachment, said receiving and releasing means comprising a drive stud having a diagonally disposed bore extending therethrough, one end of said bore being located at a portion of said drive stud adapted for insertion into said tool attachment and the other end of said bore being located above that portion of said drive stud adapted for insertion into said tool attachment, and a slidable pin movably disposed in said bore, one end of which extends outwardly from said drive stud for access for manual movement by an operator and the other end of which is constructed to provide locking engagement between said drive stud and said tool attachment when said pin is moved to one operative position and to release said tool attachment from said drive stud when said pin is moved to a second operative position, a spring for urging said pin into position for effecting locking engagement between said drive stud and said tool attachment, said spring being a coil expansion spring surrounding said drive stud and having one end anchored to said drive stud and its other end fixed to the extended end of said pin.

2. A tool as defined in claim 1 further characterized in that a protective sleeve is provided surrounding and contacting said spring whereby when lifted and lowered, it serves to lift and lower the end of said spring and with it said slidable pin.

3. A tool comprising means for attaching and releasing a tool attachment said attaching and releasing means, comprising a drive stud having a non-round end portion adapted to be inserted into a correspondingly shaped opening in a tool attachment to thereby establish a driving connection therewith, said drive stud further having a bore diagonally disposed therethrough in such manner that its outlet on one side of said drive stud is located above said non-round end portion adapted to be inserted into a tool attachment and its outlet on an opposite side of said drive stud is located within the area of said non-round end portion adapted to be inserted into a tool attachment, a member movably mounted in said diagonally disposed bore having one end projecting from the upper outlet of said bore beyond the surface of said drive stud, said movable member being capable of two repetitively used operative positions, one for attaching a tool attachment to said drive stud and the other for releasing a tool attachment from said drive stud, the other end of said movable member extending from the lower outlet of said bore to engage an inside surface of an associated tool attachment to retain the same on said drive stud when said movable member is in tool attaching position and to be retracted from retaining contact with said tool attachment when said movable member is in tool releasing position, and means associated with the end of said movable member projecting from the upper outlet of said bore beyond the surface of said drive stud, constructed and disposed to receive operating forces manually applied by the user of said tool to selectively move said movable member either to the attaching position of said tool attachment or to the releasing position of said tool attachment as desired by said user, said last named means comprising a coil spring surrounding the drive stud and having one end anchored to said drive stud and its other end fixed to the upper end of said movable member, said spring serving to retain said movable member in said diagonally disposed bore during normal operation of said tool while permitting movement of said movable member, under manual control, into said two operative positions, said spring also serving to normally urge said movable member into attaching position of said tool attachment.

4. A tool comprising means for attaching and releasing a tool attachment, said attaching and releasing means comprising a drive stud having a non-round end portion adapted to be inserted into a correspondingly shaped opening in a tool attachment to thereby establish a driving connection therewith, said drive stud further having a bore diagonally disposed therethrough in such manner that its outlet on one side of said drive stud is located above said non-round end portion adapted to be inserted into a tool attachment and its outlet on the opposite side of said drive stud is located within the area of said non-round end portion adapted to be inserted into a tool attachment, a member movably mounted in said diagonally disposed bore having one end projecting from the upper outlet of said bore beyond the surface of said drive stud, said movable member being capable of two repetitively used operative positions, one for attaching a tool attachment to said drive stud and the other for releasing a tool attachment from said drive stud, the other end of said movable member extending from the lower outlet of said bore to engage an inside surface of an associated tool attachment to retain the same on said drive stud when said movable member is in tool attaching position and to be retracted from retaining contact with said tool attachment when said movable member is in tool releasing position, and means associated with the end of said movable member projecting from the upper outlet of said bore beyond the surface of said drive stud, constructed and disposed to receive operating forces manually applied by the user of said tool to selectively move said movable member either to the attaching position of said tool attachment or to the releasing position of said tool attachment as desired by said user, said tool including means associated with said movable member for retaining said movable member in said diagonally disposed bore during normal operation of said tool while permitting movement of said movable member, under manual control, into said two operative positions.

5. A tool as defined in claims 3 or 4 further characterized in that a manually movable sleeve is provided, carried by and surrounding said drive stud and means coupling said sleeve and said projecting upper end of said movable member whereby said sleeve and movable member may be moved together to either tool releasing or tool attaching positions as desired by the operator.

6. A tool comprising means for receiving and releasing a tool attachment, said receiving and releasing means comprising a drive stud having a diagonally disposed bore extending therethrough, one end of said bore being located at a portion of said drive stud adapted for insertion into said tool attachment and the other end of said bore being located above that portion of said drive stud adapted for insertion into said tool attachment, and a movable member disposed in said bore capable of two repetitively used operative positions, one end of which extends outwardly from said drive stud and the other end of which is constructed to provide locking engagement between said drive stud and said tool attachment when said movable member is moved to the first one of said two operative positions and to release said tool attachment from said drive stud when said movable member is moved to the second of said two operative positions, and means associated with the end of said movable member which extends outwardly from said drive stud, constructed and disposed to receive operating forces manually applied by the user of said tool to selectively move said movable member either to attaching position of said tool attachment or to releasing position of said tool attachment as desired by said user of said tool, said last named means including a spring engaged with said movable member and said drive stud for retaining said movable member in said diagonally disposed bore while permitting movement of said movable member, under manual control, into said first and second operative positions.

7. A tool as defined in claims 4 or 6 further characterized in that the tool is an extension bar for use with wrenches.

8. A tool as defined in claim 4 further comprising spring means associated with said movable member for normally urging said movable member into tool attaching position.

9. A tool as defined in claim 8 further characterized in that the spring is an extension spring connected between said slidable pin and said drive stud.

10. A tool as defined in claim 4 wherein said retaining means comprises spring means for normally urging said movable member into tool attaching position.

11. A tool as defined in claim 4 wherein said means constructed and disposed to receive operating forces comprises:

a handle disposed adjacent said drive stud above said nonround end portion, said handle adapted to be manipulated through direct contact with a hand of said user, said handle being secured to the end of said movable member projecting from the upper outlet of said bore.

12. A tool as defined in claim 11 wherein said handle comprises a spring positioned to surround and be carried by said drive stud.

13. A tool as defined in claim 11 wherein said handle comprises a knob.

14. A tool as defined by claim 11 wherein said handle comprises a sleeve positioned to surround and be carried by said drive stud.

15. A tool as defined by claim 14 wherein said means constructed and disposed to receive operating forces further comprises means for supporting said sleeve on said drive stud for tilting movement.

16. A tool as defined by claim 11 wherein said handle comprises a surface of said member shaped to engage the hand of said user.

17. A tool as defined in claim 6 wherein said spring normally urges said movable member into tool attaching position.

18. A tool as defined in claim 6 wherein said spring is positioned to be manipulated through direct contact with a hand of said user, wherein said spring is secured to the end of the movable member projecting from the upper outlet of said bore, and wherein said spring is disposed adjacent said drive stud above that portion of said drive stud adapted for insertion into said tool attachment.

19. A tool as defined in claims 4 or 6 further characterized in that the tool attachment is a socket for turning nuts or bolts.

20. A tool as defined in claims 4 or 6 further characterized in that said movable member is a pin.

21. A tool as defined in claims 4 or 6 further characterized in that said movable member is a pin slidable axially in said bore.

22. A tool as defined in claim 21 further characterized in that the angle of the pin in its bore is such that, when said pin is in attaching position, the contacting parts of the tool attachment and the associated end of the pin cannot generate component of force sufficient to move the pin axially in said bore such as would release said tool attachment.

23. A tool as defined in claims 4 or 6 further characterized in that the angle of said bore is such that, when said movable member is in attaching position, the contacting parts of the tool attachment and the associated end of said movable member cannot generate a component of force sufficient to move the movable member in said bore such as would release said tool attachment.

24. A tool as defined in claims 4 or 6 further characterized in that the tool is a "speeder" type wrench.

25. A tool as defined in claims 4 or 6 further characterized in that the tool is a ratchet type of socket wrench.

26. A tool as defined in claims 4 or 6 further characterized in that said movable member is a lever.

27. A tool as defined in claims 4 or 6 further characterized in that said movable member is a pin rotatably mounted in said opening.

28. A tool as defined in claim 27 further characterized in that means are provided for locking said pin in its tool attaching and tool releasing positions.

29. A tool comprising means for receiving and releasing a tool attachment, said receiving and releasing means comprising a drive stud for receiving and releasing said tool attachment, said drive stud having a diagonally disposed opening therein, and a member movably disposed in said opening, the lower end of said opening being located at a portion of said drive stud constructed for insertion into said tool attachment, the lower end of said member being constructed to provide locking engagement between said drive stud and said tool attachment when said member is moved to a first position and to release said tool attachment from said drive stud when said member is moved to a second position, said opening extending through said drive stud such that the upper end of said opening is externally open above that portion of said drive stud constructed for insertion into said tool attachment, and means, coupled to the upper end of said member and extending outwardly from said opening above that portion of said drive stud constructed for insertion into said tool attachment, for receiving manually applied forces from an operator to move said member repetitively between said first and second positions.

30. A tool comprising means for receiving and releasing a tool attachment, said receiving and releasing means comprising a drive stud for receiving and releasing said tool attachment, said drive stud having a diagonally disposed opening therein, and a member movably disposed in said opening, the lower end of said opening being located at a portion of said drive stud constructed for insertion into said tool attachment, the lower end of said member being constructed to provide locking engagement between said drive stud and said tool attachment when said member is moved to a first position and to release said tool attachment from said drive stud when said member is moved to a second positon, said opening extending through said drive stud such that the upper end of said opening is externally open above that portion of said drive stud constructed for insertion into said tool attachment, and the upper end of said member extending outwardly from said opening above that portion of said drive stud constructed for insertion into said tool attachment and configured to receive manually applied forces from an operator to move said member repetitively between said first and second positions.

31. A tool as defined in claim 29 wherein said means for receiving manually applied forces comprises a manually movable sleeve mounted to surround and be carried by said drive stud, and means for connecting said sleeve and said upper end of said member such that manual manipulation of said sleeve moves said member between said first and second positions.

32. A tool as defined in claim 29 wherein said means for receiving manually applied forces comprises a handle secured to the upper end of said member and carried by said drive stud above that portion of said drive stud constructed for insertion into said tool attachment, said handle adapted to be manipulated by direct contact with a hand of said operator to allow the operator to move the member between the first and second positions through direct manual manipulation of the handle.

33. A tool as defined in claim 30 further comprising a manually movable sleeve mounted to surround and be carried by said drive stud, and means for connecting said sleeve and said extending upper end of said member such that manual manipulation of said sleeve moves said member between said first and second positions.

34. A tool as defined in claim 30 further comprising a handle secured to the upper end of said member and carried by said drive stud above that portion of said drive stud constructed for insertion into said tool attachment, said handle adapted to be manipulated by direct contact with a hand of said operator to allow the operator to move the member between the first and second positions through direct manual manipulation of the handle.

35. A tool as defined in claim 32 or 34 wherein said handle comprises a spring positioned to surround and be carried by said drive stud.

36. A tool as defined in claim 32 or 34 wherein said handle comprises a knob.

37. A tool as defined in claim 32 or 34 wherein said handle comprises a sleeve positioned to surround and be carried by said drive stud.

38. A tool as defined in claim 37 further comprising means for supporting said sleeve on said drive stud for tilting movement.

39. A tool as defined in claim 32 or 34 wherein said handle comprises a surface of said member shaped to engage the hand of said user.

40. A tool as defined in claim 29 wherein said means for receiving manually applied forces is configured to receive manually applied forces from the operator to move said member from the first position to the second position and thereby to release said tool attachment from said drive stud.

41. A tool as defined in claim 30 wherein said upper end of said member is configured to receive manually applied forces from the operator to move said member from the first position to the second position and thereby release said tool attachment from said drive stud.

42. A tool as defined in claim 40 or 41 further comprising means for capturing the member in the diagonally disposed opening for movement between the first and second positions.

43. A tool as defined in claim 29 or 30 wherein the tool comprises an extension bar for use with wrenches.

44. A tool as defined in claim 29 or 30 wherein the tool attachment comprises a socket for turning nuts or bolts.

45. A tool as defined in claim 29 or 30 wherein said member comprises a pin.

46. A tool as defined in claim 29 or 30 further comprising spring means associated with said member for normally urging said member into said first position.

47. A tool as defined in claim 46 wherein said spring means comprises an extension spring connected between said member and said drive stud.

48. A tool as defined in claim 29 or 30 wherein said member comprises a pin slidable axially in said opening.

49. A tool as defined in claim 29 or 30 wherein the tool comprises a "speeder" type wrench.

50. A tool as defined in claim 29 or 30 wherein the tool comprises a ratchet type socket wrench.

51. A tool as defined in claim 29 or 30 wherein said member comprises a lever.

52. A tool as defined in claim 29 or 30 wherein said member comprises a pin rotatably mounted in said opening.

53. A tool as defined in claim 52 comprising means for locking said pin in said first and second positions.

* * * * *